United States Patent [19]

Epstein et al.

[11] 4,236,569

[45] * Dec. 2, 1980

[54] FOUNDRY PROCESSES AND COMPOSITIONS

[75] Inventors: David Epstein; John Bugg, both of London, England

[73] Assignee: The White Sea & Baltic Company Limited, London, England

[ * ] Notice: The portion of the term of this patent subsequent to Sep. 5, 1995, has been disclaimed.

[21] Appl. No.: 907,438

[22] Filed: May 19, 1978

Related U.S. Application Data

[63] Continuation-in-part of Ser. No. 761,756, Jan. 24, 1977, Pat. No. 4,111,253, which is a continuation-in-part of Ser. No. 282,633, Aug. 21, 1972, abandoned.

[51] Int. Cl.[3] ..... B22C 1/22

[52] U.S. Cl. ..... 164/43; 260/29.3; 260/29.4 R; 260/38; 260/39 SB

[58] Field of Search ..... 260/29.3, 29.4 R, 38, 260/39 SB, DIG. 40; 164/43

[56] References Cited

U.S. PATENT DOCUMENTS

| | | | |
|---|---|---|---|
| 3,424,600 | 11/1969 | Liass et al. | 106/38.35 |
| 3,720,642 | 3/1973 | Junger et al. | 260/38 |
| 3,734,936 | 5/1973 | Brown et al. | 260/39 SB |
| 3,993,117 | 11/1976 | Chevriot et al. | 164/43 |

FOREIGN PATENT DOCUMENTS 1430841 4/1976 United Kingdom .

*Primary Examiner*—Lorenzo B. Hayes

*Attorney, Agent, or Firm*—Lawrence Rosen; E. Janet Berry

[57] ABSTRACT

When making a foundry mould or core from a fluid mixture comprising sand and a foamed aqueous phase comprising resin condensate, foaming agent and acid curing agent and that is a stable foam, improved results are obtained if the fluid mixture is obtained by forming a fluid mix of the sand, resin condensate and foaming agent and then mixing the acid curing agent into this.

12 Claims, No Drawings

FOUNDRY PROCESSES AND COMPOSITIONS

This application is a continuation in part of our application Ser. No. 761,765 filed Jan. 24, 1977, now U.S. Pat. No. 4,111,253, which is a continuation in part of our application Ser. No. 282,633 filed Aug. 21, 1972 now abandoned.

The normal way of making a foundry mould or core comprises shaping a mixture of foundry sand and of binder in a mould or core box and allowing the mixture to set, preferably at room temperature. It is often preferred to use an organic resin condensate as the binder in which event the mixture has to include also an acid catalyst to promote setting. The normal way of making such a mixture is to disperse the catalyst uniformly through the sand and then to add binder. If the mix is formed the other way round, with the acid catalyst being added to a preformed mix of binder and sand, localised curing of the binder starts immediately the acid contacts the mixture and so non-uniform curing occurs.

Conventional mixtures of sand and binder that are to be shaped behave substantially as solids and have to be rammed or otherwise mechanically forced into the core or mould box. In British Patent Specification No. 1,085,651 and U.S. Pat. No. 3,424,600 Liass disclosed the concept of making a fluid sand composition in which the aqueous phase was foamed, as a result of which the composition could be shaped merely by pouring it into the box. Unfortunately the specific compositions described by Liass are not entirely satisfactory, even when the mould is vibrated. In the process of Liass and subsequent proposals of making fluid mixtures of foundry sand and a foamed aqueous phase it seems generally to have been considered desirable or necessary that the materials used and the conditions of mixing should be such that the foam collapses soon after its formation and usually quickly, e.g. a few seconds or minutes, after being poured into the mould or core box. Thus the foam collapses before setting and as a result a permeable set structure is obtained that is substantially denser and stronger than would be obtainable if the foam had not collapsed before setting. Also in these processes the usual order of mixing the sand, binder and catalyst (i.e. catalyst first) seems to have been generally accepted as being necessary and indeed the only disclosures of which we are aware of processes in which the acid is added to a preformed fluid mix of sand and foamed aqueous phase containing binder are Examples 12 and 13 of British Patent Specification No. 1,430,841 and it is stated in that specification that the compressive strength of the products of these Examples is inferior to the compressive strength of the products of the other Examples in that specification (in which acid is mixed with the sand before the binder was added) even though more acid was used.

In British Patent Specification No. 1,373,647 and in our application Ser. No. 761,756 filed Jan. 24, 1977, now U.S. Pat. No. 4,111,253 the disclosure of which is incorporated herein by reference, we have described how improved results can be achieved if the compositions contains a silane and in the described process the foam is stable, that is to say it does not break until the composition sets, the foam bubbles breaking during setting. Such processes are very advantageous because the stability of the foam means that the composition will conform accurately to the mould during setting and will not shrink away from complex shapes before setting and the preferred compositions described in that specification using a silane and, preferably, a sodium lauryl ether sulphate foaming agent, are capable of giving good overall strength and in particular good surface smoothness and strength. The conventional method of forming foundry mixtures was described in that specification, the acid being mixed with the sand before addition of the binder.

In a first aspect of the invention we have now found that when making a foundry mould or core by a process comprising forming a fluid mixture that is stable against collapse before setting and that comprises fluid sand and an aqueous phase comprising resin condensate, surfactant foaming agent and an acid catalyst, pouring the fluid mixture into a mould or core box and allowing the mixture to set, particularly advantageous results are obtained if the fluid mixture is made by forming a fluid mixture of the sand and a foamed aqueous phase comprising the resin condensate and foaming agent and then mixing the acid curing agent into this. Thus the acid is added to a preformed mixture of sand and binder in contradistinction to the conventional methods in which it is mixed with the sand before the binder is added.

When all other conditions are constant, this new order of mixing yields a mixture having improved fluidity compared to that obtainable with the conventional order of mixing and thus the mixture will more readily flow into the mould or core and conform more accurately to its shape without the need for mechanical assistance, e.g. ramming or vibration of the mould or core box. Accordingly in the preferred process no consolidation techniques are applied and the mould or core box remains immobile throughout.

The reason for the remarkable improvement in fluidity is not known, but surprisingly the new order of mixing does not seem to yield good fluidity in the more usual, unstable, foams that collapse substantially immediately on pouring, and indeed tests we have conducted show that it may often give worse fluidity than is obtained by the conventional order of mixing.

Another surprising advantage of the invention is that it is possible to reduce the amount of all components in the mixture other than sand, and thereby achieve substantial economies, without detrimentally affecting the quality of the cured product, and indeed this reduction can often be achieved together with improvement in the quality of the product. Thus the new order of mixing permits the amount of foaming agent necessary to achieve a mix of adequate fluidity to be reduced and as the foaming agent does not contribute to the strength of the cured mixture, and indeed may result in weakening of it due to disruption of the continuity of the resin, this reduction in the amount of foaming agent compared to that necessary with the conventional order of mixing can result in a product of improved strength. Accordingly some reduction in the quantity of bonding agent is permissible while still obtaining a product of equivalent or better strength than that obtainable with the conventional order of mixing and similarly a reduction in the quantity of catalyst is also possible. Thus by reversing the order of mixing when making a stable fluid mixture it is possible to obtain much greater fluidity in the mixture or to use less foaming agent and obtain a stronger mixture or, and this is generally preferred, to achieve increases both in the fluidity and strength accompanied by a decrease in the amount of foaming agent and generally also binder and catalyst.

A number of surfactant foaming agents are capable of giving fluid mixtures that are stable against collapse before setting, including certain fatty amido alkyl betaines, such as that sold under the trade name "Lorapon AMB13" which is a cocoamide alkyl betaine, and certain substituted imidazolines such as those sold under the trade names "Crodateric C" and "Crodateric L" but the strength of the cured product with these may not be as high as is desirable even when used in the composition of British Patent Specification No. 1,373,647, and best results are obtainable when using a lauryl ether sulphate, generally sodium lauryl ether sulphate.

Suitable sodium lauryl ether sulphates are those obtained by ethoxylating lauryl alcohol with, for instance, a chain of three ethoxy groups, and sulphating the product. Examples of such materials are those sold by Lankro Chemicals under the trade name "Perlankrol ESD" and those sold by Albright & Wilson Limited under the trade names "Empimin KSN 27" and "Empimin KSN 60". They are all an industrial grade of sodium lauryl ether sulphate based on a narrow cut lauryl alcohol, "Perlankrol ESD" and "Empimin KSN 27" being 27% aqueous solutions and "Empimin 60" being a 60% aqueous solution containing about 10% ethanol.

The amount of foaming agent will be chosen having regard to the stability that is desired upon pouring and having regard to the choice of foaming agent and other components in the mix. Generally the amount is from 0.05 to 0.5%, preferably 0.1 to 0.5%, dry weight based on the weight of foundry sand. In general rather more foaming agent is needed when the resin is a phenolic resin than when it is, for instance, a urea formaldehyde and/or furfuryl alcohol resin.

The resin condensates used are preferably furfuryl alcohol/formaldehyde, phenol/formaldehyde or urea/formaldehyde resin condensates but it can be advantageous for the binder composition also to contain free furfuryl alcohol. The resin condensates are usually water-soluble and are normally available and used in the form of aqueous compositions, e.g. solutions, containing from 1 to 30% by weight of water. The aqueous resin condensate composition is usually used in an amount of 1 to 5% based on the weight of the foundry sand e.g. 0.75 to 4.5% resin solids. Preferably we use 0.8 to 2%, preferably 1 to 1.75%, of aqueous resin condensate, the condensate usually containing 20% water if the resin comprises urea formaldehyde and 10% water if the resin comprises phenol formaldehyde.

In order to improve the strength of the products and especially the surface strength, it is preferred to include a silane in the fluid mixture, for instance as described in British Patent Specification No. 1,373,647. The silane is best dissolved in the resin before the resin is mixed with the sand. Especially when the resin is not a urea formaldehyde resin, i.e. when it is a phenol and/or furfuryl alcohol-formaldehyde resin, the silane is preferably mixed with the resin only just before the resin is mixed with the sand.

The silane must be one that will improve the strength of a composition containing the binder, some silanes being more suitable for use with some binders than others. In general the silane will be preferably of general formula $R'Si(OR)_3$ in which R' is a $C_2$–$C_6$ alkylene group bonded to an amino, epoxy, mercapto, hydroxy, hydroxy-$C_1$–$C_6$ alkylamino, amino-$C_1$–$C_6$ alkylamino, $C_2$–$C_6$ alkenyl or $C_2$–$C_6$ alkenyl-carboxy group and the groups R may be the same or different and are selected from $C_1$–$C_6$ alkyl and $C_1$–$C_6$ alkoxy-substituted-$C_1$–$C_6$ alkyl. The amount of silane used is usually from 0.05 to 0.5%, preferably from 0.1 to 0.2%, based on the total weight of aqueous resin condensate composition and silane.

Any acid that will serve as a curing agent for the resin condensate may be used in the invention and many such acid curing agents are known. Preferred curing agents comprise one or more of phosphoric acid, p-toluene sulphonic acid and sulphuric acid, mixtures of the last two being particularly preferred. The amount of curing agent, on a non-aqueous basis, is generally from 10 to 150%, preferably 50 to 75% by weight based on the amount of resin solids or 0.3 to 2% based on the weight of foundry sand. However the curing agents are preferably introduced as aqueous solutions generally containing 15 to 40% water. The amount of aqueous curing agent is generally 10 to 150%, preferably 50 to 75%. based on aqueous resin condensate or 0.5 to 2.5% based on the weight of foundry sand.

The amount of water used in the invention should be low but not too low. If too much is used, above 2% the fluidity of the sand may be quite satisfactory but the final strength of the product will be wholly unsatisfactory. If too little is used, which in practice means if less than about 0.9 or 1% is used, it will be impossible to make a fluid mixture since an appropriate foamed aqueous phase will not exist. Water is usually introduced both with the resin condensate and the curing agent and so preferably no additional water is added.

We have now surprisingly found that, possibly due in some instances at least to the reduction in the amount of binder that can be used while obtaining satisfactory, fluidity, the amount of water in the total mixture can be reduced far below the 2.0% figure suggested in our British Patent Specification No. 1,373,647. While 1.3 to 1.8% is often a convenient range for many systems, when the binder is free of urea and is a condensate of two or more of phenol, formaldehyde and furfuryl alcohol an even lower amount of water is preferred. Thus the amount is then preferably 0.9 to 1.5% and most preferably 0.9 to 1.25%.

Any particular inorganic material suitable for use as the sand of a foundry mould or core may be used in the invention, conventional sand being preferred.

To make a foundry mould or core in the invention preferably the sand, binder, silane and foaming agent are mixed together under conditions and for a duration sufficient to obtain adequate distribution of the components and a foamed aqueous phase, the acid catalyst is then added and further mixing is conducted, and the mixture is then poured. The duration of each mixing step depends inter alia upon the type of mixer being used. Conventional mixers are satisfactory. The first mixing stage often lasts from 1 second to 3 minutes, e.g. 1 to 30 seconds in a continuous mixer or 1 to 3 minutes in a batch mixer, while the second mixing stage, after or during adding the acid, often lasts 1 to 90 seconds, e.g. 1 to 30 seconds in a continuous mixer or 30 to 90 seconds in a batch mixer.

In the preferred processes of the invention the mixture has very high stability against collapse before curing, and as a result it is not necessary to select the quantity of each component as critically as has to be done with many conventioanl processes, where the foam is designed to collapse, or at least does collapse, very quickly. Whether or not foam has collapsed can be determined by measuring the permeability of the cured mould, since if curing occurs before there is any substantial collapse the permeability and density of the mould will be low whilst if there has been substantial collapse of the foam before the mix starts setting the density (and strength) and permeability would be higher.

The following are Examples of the invention. In these the viscosity figure is the time in seconds during which 2 kg sand drops from the mixer in the test described below. It is desirable for the figure to be as low as possible since low figures indicate low viscosity and therefore a mixture which will pour easily and conform accurately to an intricately shaped mould. The viscosity test uses a viscometer which consists of mild steel vessel with an opening at the bottom. The shape of the vessel is a cylinder of 170 mm diameter 180 mm high finishing at the bottom with a cone 65 mm high and cut for the outlet. The diameter of the outlet is 45 mm and it is closed by a shutter connected electrically with a stop watch. Inside the cylinder there is a stirrer with 8 blades round the vertical shaft and which rotates at 85 revs per minute.

The mixer serves to prepare a mix of 4000 grammes of fluid sand. When ready (after 4½ mins of mixing) the shutter is opened manually and sets the stop watch in motion. The sand drops into a tared container. Its bottom is placed 350 mm below the opening of the mixer. The container is placed on a scale having a dish which, when it receives a weight of 2 kg of sand, tilts and electrically stops the stop watch to record the viscosity figure that is quoted.

Examples 1, 3, 11, 13, 15, 19, 20 and 21 are Examples of the invention whilst the remaining examples are comparative.

EXAMPLES 1 TO 4

4 kg sand, binder (B), foaming agent (F) and 60 g (1.5%) curing agent (C) were mixed in the amounts and order given below in Table 1 in the vessel described above the the viscosity of the mix was measured as described above. The binder was a phenol formaldehyde furfuryl alcohol binder containing 10% water and 0.2% silane (the product sold as A1100), the foaming agent was the 27% solution of sodium lauryl ether sulphate sold under the trade name "Perlankrol ESD" and the curing agent was a composition having 33.13% water content and formed from 83.34% paratoluene sulphonic acid, 14.32% of 77% sulphuric acid and 2.34% water. The total amount of water in each mix was about 1.4% based on the weight of sand.

In Examples 2 and 4 the foaming agent and catalyst were first mixed with the sand thoroughly by a paddle mixer for 2½ minutes, by which time the aqueous phase has foamed and the mixture fluid, and the binder and silane were then added and mixed with the paddle mixer for another minute, whereupon the viscosity was measured and the mixture was poured into a mould or core and left to set. Examples 1 and 3 were carried out in the same manner except that the binder, silane and foaming agent were mixed with the sand in the initial 2½ minute mixing period and the curing agent was added afterwards, for the final minute mixing. The results obtained are shown in Table I.

Comparison of Example 1 with 2 and of Examples 3 with 4 shows that by adding the catalyst at the end, instead of at the beginning, the viscosity is almost halved in these examples and this is an indication of the great increase in fluidity obtainable by the invention.

TABLE I

| Example | Binder (B) g | Binder (B) % | Foam Agent (F) g | Foam Agent (F) % | Order of Addition | Viscosity |
|---|---|---|---|---|---|---|
| 1 | 71.5 | 1.7875 | 38.5 | 0.9625 | B + F;C | 13½ |
| 2 | 71.5 | 1.7875 | 38.5 | 0.9625 | F + C;B | 26 |
| 3 | 70 | 1.75 | 36 | 0.9 | B + F;C | 15 |
| 4 | 70 | 1.75 | 36 | 0.9 | F + C;B | 28 |

In each of Examples 1 to 4 the composition was poured into a mould and upon curing in the mould a product having good compression strength and having very high surface finish but having low density was obtained.

EXAMPLES 5 TO 16

4 kg of Chelford 50 sand were mixed with the binder used in Example 1 and with foaming agent, and acid in the amounts and order specified in Table II in the vessel described above and the viscosity of the mix was measured as described above. When the acid (C) was mixed with the sand and foaming agent (F) before the binder (B), C and F were introduced together by adding 2½% based on sand, of a mixture of 40% of a 27% solids solution of foaming agent, 50% of 67% solids paratoluene sulphonic acid, 8.6% of 77% sulphuric acid and 1.4% water, and 1.75% of the binder added after 2½ minutes and the product mixed for a further 1½ minutes. When the binder and foaming agent were added first 70 g (1.75%) of binder and 40 g (1%) of the surfactant were added and after 2½ minutes mixing 60 g (1½%) of the same acid mixture was added and the mix mixed for a further 1½ minutes.

TABLE II

| Example | Foaming Agent | Order of Addition | Viscosity | Stability of foam |
|---|---|---|---|---|
| 5 | Cordanol SBL 35 | B + F;C | 77 | unstable |
| 6 | " | C + F;B | not fluid | — |
| 7 | Armac C | B + F;C | 35 | unstable |
| 8 | " | C + F;B | 15½ | more stable |
| 9 | Armeen 12D | B + F;C | 19 | unstable |
| 10 | " | C + F;B | 16 | more stable |
| 11 | Lorapon AM B13 | B + F;C | 16½ | stable |
| 12 | " | C + F;B | 20% | stable |
| 13 | Empicol ES B3 | B + F;C | 48 | stable |
| 14 | " | C + F;B | 58 | less stable |
| 15 | Empimin KSN 27 | B + F;C | 13½ | stable |
| 16 | " | C + F;B | 18½ | stable |

Cordanol SBL 35 is a fatty acid alkanolamide sulphosuccinate.
Armac C is an acetate salt of $C_{6-18}$ coconut amine.
Armeen 12 D is 97% lauryl amine.
Lorapon AM B13 is cocoamido alkyl betaine.
Empicol Es B3 is sodium ethoxylated lauryl alcohol, and
Empimin KSN 27 is sodium lauryl ether sulphate.

After pouring and curing the product of Examples 15 and 16 had the best strength, but it is clear that Example 15 gave the mixture having the greatest fluidity.

Examples 5, 7 and 9 used the surfactants and the order of mixing proposed in Examples 12 and 13 of British Patent Specification No. 1,430,841, which are the only disclosures of which we are aware showing the addition of curing agent to a preformed fluid mixture of sand and foamed aqueous phase containing foaming agent and binder, but as is apparent from each of these Examples the fluid mixture was in fact unstable, as defined above. This is only to be expected as it is clear that Specification No. 1,430,841 is concerned solely with unstable foams as it requires that the foam shall substantially completely subside before the sand begins to set. Example 6 shows that if the order of mixing in Example 5 is reversed a non-fluid mix is obtained whilst Examples 8 and 10 show that if the order of mixing in Examples 7 and 9 respectively is reversed a more stable foam is obtained having greater fluidity than the mixes in Examples 7 and 9, that is to say the addition of the curing agent to the preformed fluid mixture reduces the fluidity of the mix, whereas in the stable foams of the invention it increases the fluidity of the mix. In Example 5 the fluidity of the system was so low that the mould had to be vibrated. Examples 11 to 16 all give stable foams and in each instance it is clear that a more fluid mixture is obtained when the curing agent is added last than when it is added first.

EXAMPLE 17

In this Example 13 of British Patent Specification No. 1,430,841 is reproduced more accurately than in the preceding Examples. The mixtures were formed using the same technique as above from the recipe 50 parts of sand
1 part of binder (45% ureformaldehyde resin plus 55% furfuryl alcohol)
1 part of catalyst (18% phosphoric acid, 18% sulphuric acid, 64% water)
0.05 foaming agent
0.05 water In tests A and B the foaming agent was lauryl amine acetate (Armac C) while in tests B and C the foaming agent was 97% lauryl amine (Armeen 12D). The results are as follows:

TABLE III

| Test | Order of Mixing | Viscosity |
|---|---|---|
| 17A | B + F;C | 39½ |
| 17B | C + F;B | 31½ |
| 17C | B + F;C | 31½ |
| 17D | C + F;B | 26 |

In all instances the foam was unstable and adding the curing agent last, instead of before the binder, made the mixture less fluid.

EXAMPLES 18 TO 21

In these Examples the binder and foaming agent and apparatus used were broadly as described in Example 1, the catalyst was p-toluene sulphonic acid and the compressive strength after 24 hours was recorded in pounds per square inch. In Example 18 the binder was added last while in Examples 19 to 21 the curing agent was added last, and the amount of foaming agent and curing agent was reduced in Examples 19 and 20 and in Example 21 the amount of binder was also reduced. The results are given in Table IV. In Example 18 the amount of water in the mixture is about 1.4% but in the other Examples it is from about 0.9 to about 1.2%.

TABLE IV

| Example | 18 | 19 | 20 | 21 |
|---|---|---|---|---|
| Binder | 1.75% | 1.75 | 1.75 | 1.5 |
| Foaming Agent | 1.0 | 0.6 | 0.7 | 0.8 |
| Acid | 1.5 | 1.0 | 1.0 | 1.0 |
| PTSA | C + F;B | B + F;C | B + F;C | B + F;C |
| Viscosity | 21¾ | 23 | 18½ | 17 |
| Compressive Strength | 320 | 370 | 350 | 320 |

Example 19 shows that by mixing in the invention it is possible to have a very large reduction in the amount of foaming agent and curing agent, with a very small increase in viscosity and a significant increase in compressive strength, while Examples 20 and 21 show that by having a slightly smaller decrease in the amount of foaming agent one can obtain a desirable decrease in viscosity and improved compressive strength or, with less binder, an equivalent compressive strength and even greater reduction in viscosity.

We claim:

1. In a method of making a foundry mould or core which comprises forming a fluid mixture that is stable against collapse before setting and that comprises a foundry sand and a foamed aqueous phase comprising resin condensate, surfactant foaming agent and an acid curing agent, pouring the fluid mixture into a mould or core box which is immobile and allowing the mixture to set without vibration of the mould or core box or ramming of the fluid mixture or other consolidation techniques; the improvement which comprises the steps of preparing the fluid mixture by blending the sand and foamed aqueous phase comprising the resin condensate and foaming agent and thereafter adding and mixing the acid curing agent into said foamed fluid mixture wherein the foaming agent is selected from the group consisting of fatty amido alkyl betaines, substituted imidazolines, and lauryl ether sulphates.

2. In the method according to claim 1 in which the foaming agent is a sodium lauryl ether sulphate containing 3 ethoxy groups.

3. In the method according to claim 1 in which the curing agent is an aqueous solution comprising one or more of phosphoric acid, p-toluene sulphonic acid and sulphuric acid.

4. In the method according to claim 1 in which the resin condensate is an oligomeric form of formaldehyde with one or more of furfuryl alcohol, phenol and urea.

5. In the method according to claim 1 in which a silane is included in the said fluid mixture.

6. In the method according to claim 5 in which the silane has the general formula $R'Si(OR)_3$ in which R' is a $C_2$–$C_6$ alkylene group bonded to an amino, epoxy, mercapto, hydroxy, hydroxy-$C_1$–$C_6$ alkylamino, amino-$C_1$–$C_6$ alkylamino, $C_2$–$C_6$ alkenyl or $C_2$–$C_6$ alkenyl-carboxy group and the groups R may be the same or different and are selected from $C_1$–$C_6$ alkyl and $C_1$–$C_6$ alkoxy-substituted-$C_1$–$C_6$ alkyl.

7. In the method according to claim 1 in which the fluid mixture is made by forming a fluid mix of the sand and a foamed aqueous phase comprising up to 5% of an aqueous resin condensate containing 1 to 30% water and an oligomeric form of formaldehyde with one or more of furfuryl alcohol, phenol and urea, 0.05 to 0.5% by weight based on the weight of aqueous resin condensate of a silane which has the general formula $R'Si(OR)_3$ in which R' is a $C_2$–$C_6$ alkylene group bonded to an amino, epoxy, mercapto, hydroxy, hydroxy-$C_1$–$C_6$ alkylamino, amino-$C_1$–$C_6$ alkylamino, $C_2$–$C_6$ alkenyl or $C_2$–$C_6$ alkenyl-carboxy group and the groups R may be the same or different and are selected from $C_1$–$C_6$ alkyl and $C_1$–$C_6$ alkoxy-substituted-$C_1$–$C_6$ alkyl, and sodium lauryl ether sulphate.

8. In the method according to claim 7 in which the amount of water is 0.9 to 1.5%.

9. In a method of making a foundry mould or core which comprises forming a fluid mixture comprising foundry sand and a foamed aqueous phase comprising resin condensate, said resin condensate, being an oligomeric form of formaldehyde with one or more of furfuryl alcohol, phenol and urea, surfactant foaming agent, acidic curing agent and a silane, said silane having the general formula $R'Si(OR)_3$ in which R' is a $C_2$–$C_6$ alkylene group bonded to an amino, epoxy, mercapto, hydroxy, hydroxy-$C_1$–$C_6$ alkylamino, amino-$C_1$–$C_6$ alkylamino, $C_2$–$C_6$ alkenyl or $C_2$–$C_6$ alkenyl-carboxy group and the group R may be the same or different and are selected from $C_1$–$C_6$ alkyl and $C_1$–$C_6$ alkoxy-substituted-$C_1$–$C_6$ alkyl, pouring the composition while fluid into a mould or core box which is immobile and allowing the fluid composition to set without vibration of the mould or core box or ramming of the fluid mixture or other consolidation techniques, in which process the amount of silane is from 0.05 to 0.5% by weight based on the weight of silane and resin condensate, the total amount of water in the mixture is less than 2% by weight of the mixture but is more than the minimum necessary to cause foaming of the aqueous phase to render the mixture fluid, and the foamed aqueous phase retains its foamed structure until setting starts; the improvement which comprises the steps of preparing the fluid mixture by blending the sand and foamed aqueous phase comprising the resin condensate and the foaming agent and thereafter adding and mixing the acid curing agent into said foamed fluid mixture wherein the foaming agent is selected from the group consisting of fatty amido alkyl betaines, substituted imidazolines, and lauryl ether sulphates.

10. In the method according to claim 9 in which the foaming agent is a sodium lauryl ether sulphate containing 3 ethoxy groups.

11. In the method according to claim 9 in which the total amount of water in the mix is 0.9% to 1.5% and acid curing agent is one or more of phosphoric acid, p-toluene sulphonic acid and sulphuric acid.

12. In the method according to claim 9 in which the amount of water is 0.9% to 1.25%.

* * * * *